US008475207B2

(12) United States Patent
Obata et al.

(10) Patent No.: US 8,475,207 B2
(45) Date of Patent: Jul. 2, 2013

(54) ELECTRICAL CONNECTOR WITH CONTACT RETENTION LATCH

(71) Applicant: Japan Aviation Electronics Industry, Ltd., Tokyo (JP)

(72) Inventors: Yusuke Obata, Tokyo (JP); Nobuyasu Oiri, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 0 days.

(21) Appl. No.: 13/689,129

(22) Filed: Nov. 29, 2012

(65) Prior Publication Data

US 2013/0109211 A1 May 2, 2013

Related U.S. Application Data

(62) Division of application No. 12/849,332, filed on Aug. 3, 2010, now Pat. No. 8,376,778.

(30) Foreign Application Priority Data

Apr. 22, 2010 (JP) ..... 2010-098756

(51) Int. Cl.
*H01R 13/40* (2006.01)

(52) U.S. Cl.
USPC ..... 439/595

(58) Field of Classification Search
USPC ..... 439/595, 603, 744
See application file for complete search history.

(56) References Cited

U.S. PATENT DOCUMENTS

| | | | | |
|---|---|---|---|---|
| 4,343,523 | A | 8/1982 | Cairns et al. | |
| 4,557,542 | A | 12/1985 | Coller et al. | |
| 4,602,837 | A | 7/1986 | Sian et al. | |
| 4,714,437 | A | 12/1987 | Dyki | |
| 5,088,938 | A | 2/1992 | Murakami et al. | |
| 5,256,084 | A | 10/1993 | Kodama | |
| 5,743,762 | A * | 4/1998 | Takahashi | 439/595 |

(Continued)

FOREIGN PATENT DOCUMENTS

| | | |
|---|---|---|
| JP | 62-008476 A | 1/1987 |
| JP | 01-117077 U | 8/1989 |

(Continued)

OTHER PUBLICATIONS

Japanese Office Action issued in corresponding JP Application No. 2010-098756 and English translation; Jan. 10, 2012; 5 pages.

(Continued)

*Primary Examiner* — Neil Abrams
(74) *Attorney, Agent, or Firm* — Foley & Lardner LLP

(57) ABSTRACT

A connector includes a contact, a housing having a cavity into which the contact may be inserted formed therein, the housing retaining the contact inserted into the cavity, and a retainer piece that may be inserted into the cavity in the direction opposite to an insertion direction. The housing includes a pressing piece that moves the contact inserted into the cavity in the moving direction substantially perpendicular to the insertion direction, an abut part that the contact abuts due to the movement by the pressing piece, and a locking member that locks the contact abutted to the abut part. The retainer piece is inserted into a back-side gap formed between the contact and an inner wall surface of the housing due to the movement by the pressing piece.

2 Claims, 14 Drawing Sheets

U.S. PATENT DOCUMENTS

| | | | | |
|---|---|---|---|---|
| 5,860,835 | A * | 1/1999 | Ohsumi | 439/595 |
| 5,879,192 | A | 3/1999 | Machida et al. | |
| 5,944,557 | A * | 8/1999 | Fukuda | 439/595 |
| 6,062,906 | A | 5/2000 | Tanaka | |
| 6,171,140 | B1 | 1/2001 | Anbo et al. | |
| 6,824,428 | B2 | 11/2004 | Tabata et al. | |
| 7,048,584 | B1 | 5/2006 | Morello et al. | |
| 7,179,136 | B1 | 2/2007 | Morello | |
| 7,232,339 | B1 | 6/2007 | Wilson et al. | |
| 7,384,309 | B1 | 6/2008 | Morello et al. | |
| 7,438,585 | B2 | 10/2008 | Morello | |
| 7,517,247 | B2 | 4/2009 | Hiramatsu | |
| 7,658,645 | B1 | 2/2010 | Morello et al. | |
| 7,959,465 | B2 | 6/2011 | Saur et al. | |
| 8,376,778 | B2 * | 2/2013 | Obata et al. | 439/595 |
| 2006/0292928 | A1 | 12/2006 | Morello et al. | |
| 2011/0263148 | A1 | 10/2011 | Obata et al. | |

FOREIGN PATENT DOCUMENTS

| | | | |
|---|---|---|---|
| JP | 04-027588 | U | 3/1992 |
| JP | 06-029059 | A | 2/1994 |
| JP | 2000-223198 | A | 8/2000 |
| JP | 2007-005310 | A | 1/2007 |
| JP | 2007-311294 | A | 11/2007 |
| JP | 2010-049841 | A | 3/2010 |

OTHER PUBLICATIONS

Notice of Reason for Rejection with English translation issued in Japanese patent application No. 2010-098756, dated Jul. 3, 2012, 5 pgs.

USPTO Notice of Allowance, U.S. Appl. No. 12/849,332, Oct. 25, 2012, 7 pages.

USPTO Office Action U.S. Appl. No. 12/849,332, Mar. 15, 2012, 7 pages.

USPTO Office Action U.S. Appl. No. 12/849,332, Jul. 9, 2012, 6 pages.

Office Action in Japanese patent application No. 2012-040175 with English translation; issued Apr. 2, 2013; 4 pages.

* cited by examiner

DISTAL END SIDE

BASE END SIDE

ELECTRICAL CONNECTOR WITH CONTACT RETENTION LATCH

INCORPORATION BY REFERENCE

This application is a divisional of application Ser. No. 12/849,332, filed Aug. 3, 2010, now pending, and based on Japanese Patent Application No. 2010-098756, filed Apr. 22, 2010, the disclosures of which are incorporated herein by reference in their entirety.

BACKGROUND OF THE INVENTION

1. Field of the Invention

The present invention relates to a connector and a waterproof connector.

2. Description of Related Art

As a related art, Japanese Unexamined Patent Application Publication No. 2007-5310 discloses an electrical connector 53 that includes a connector body 51 having a terminal-receiving cavity 50 formed therein, and a terminal 52 that may be inserted into the terminal-receiving cavity 50, as shown in FIG. 13 of the present application. The connector body 51 includes a lock nib 55 that extends from a rigid floor 54 in the terminal-receiving cavity 50. Further, a flexible beam 56 is formed in the opposite side of the rigid floor 54. The flexible beam 56 includes a protuberance or a terminal hold down bump 57, and the terminal hold down bump 57 extends toward the rigid floor 54 at a location substantially opposite to the lock nib 55. With this structure, when the terminal 52 rides up the lock nib 55 in assembling the electrical connector 53, a top surface 58 of the terminal 52 engages with the terminal hold down bump 57, the flexible beam 56 flexes upward to accommodate the movement of the terminal 52 between the lock nib 55 and the terminal hold down bump 57. After that, the elastic force of the flexible beam 56 applied to the top surface 58 of the terminal 52 again urges the terminal 52 against the rigid floor 54 and the terminal 52 is seated in the terminal-receiving cavity 50 of the connector body 51. At this time, the lock nib 55 engages with a rigid lock edge 59 of the terminal 52, thereby preventing the terminal 52 from being removed from the terminal-receiving cavity 50.

SUMMARY OF THE INVENTION

The electrical connector 53 disclosed in Japanese Unexamined Patent Application Publication No. 2007-5310 still needs to be improved in terms of looseness of the terminal 52 in the terminal-receiving cavity 50.

One of the objects of the present invention is to provide a connector which is capable of effectively suppressing looseness of a contact in a cavity.

According to one aspect of the present invention, there is provided a connector formed as follows. A connector includes a contact, a housing having a cavity into which the contact may be inserted formed therein, the housing retaining the contact inserted into the cavity, and a supporting piece that may be inserted into the cavity in the direction opposite to a direction in which the contact is inserted. The housing includes a pressing piece that moves the contact inserted into the cavity in the direction substantially perpendicular to the direction in which the contact is inserted, an abut part that the contact abuts due to the movement by the pressing piece, and a locking member that locks the contact abutted to the abut part. The supporting piece is inserted into a gap formed between the contact and an inner wall surface of the housing due to the movement by the pressing piece.

The connector above is further formed as follows. The supporting piece has a pressing piece state sensing part formed therein, the pressing piece state sensing part abutting the pressing piece which is in a first state before the movement of the contact, the pressing piece state sensing part being contained in a gap formed between the pressing piece which is in a second state after the movement of the contact and the inner wall surface of the housing.

The connector above is further formed as follows. The supporting piece has a fitting state sensing part formed therein, the fitting state sensing part abutting a distal end of the contact when the contact is in a half-fitting state in which the contact is not completely fitted to the housing, the fitting state sensing part passing the distal end of the contact to be inserted into the housing when the contact is in a fitting state in which the contact is completely fitted to the housing.

The connector above is further formed as follows. The supporting piece includes a first supporting part and a second supporting part, the first supporting part being contained in a first gap which is the gap in a back side than the pressing piece in the contact insertion direction, the gap formed between the contact and the inner wall surface of the housing due to the movement by the pressing piece, the second supporting part being contained in a second gap which is the gap in a front side than the pressing piece in the contact insertion direction.

The connector above is further formed as follows. At least one of the second supporting part of the supporting piece and the pressing piece has a sloped surface formed therein, the sloped surface being for retracting the pressing piece away from the contact when the second supporting part passes between the contact and the pressing piece in the direction opposite to the contact insertion direction.

The connector above is further formed as follows. The supporting piece has a tapered part, the tapered part being contained in a gap formed between the pressing piece and the inner wall surface of the housing.

The connector above is further formed as follows. The supporting piece has a pressing piece contain space formed therein, the pressing piece contain space being capable of containing the pressing piece between the first supporting part and the second supporting part so that a state of the pressing piece before the supporting piece is inserted into the cavity and a state of the pressing piece after the supporting piece is inserted into the cavity are substantially the same.

According to another aspect of the present invention, there is provided a waterproof connector including the connector described above, and a sealing that prevents intrusion of moisture into the housing.

According to the present invention, a gap formed between the contact and the inner wall surface of the housing due to the movement by the pressing piece disappears by the supporting piece, thereby effectively suppressing looseness in the cavity.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS

First Exemplary Embodiment

Hereinafter, a first exemplary embodiment of the present invention will be described with reference to FIGS. 1 to 7B.

(Connector 1)

Figure 1:
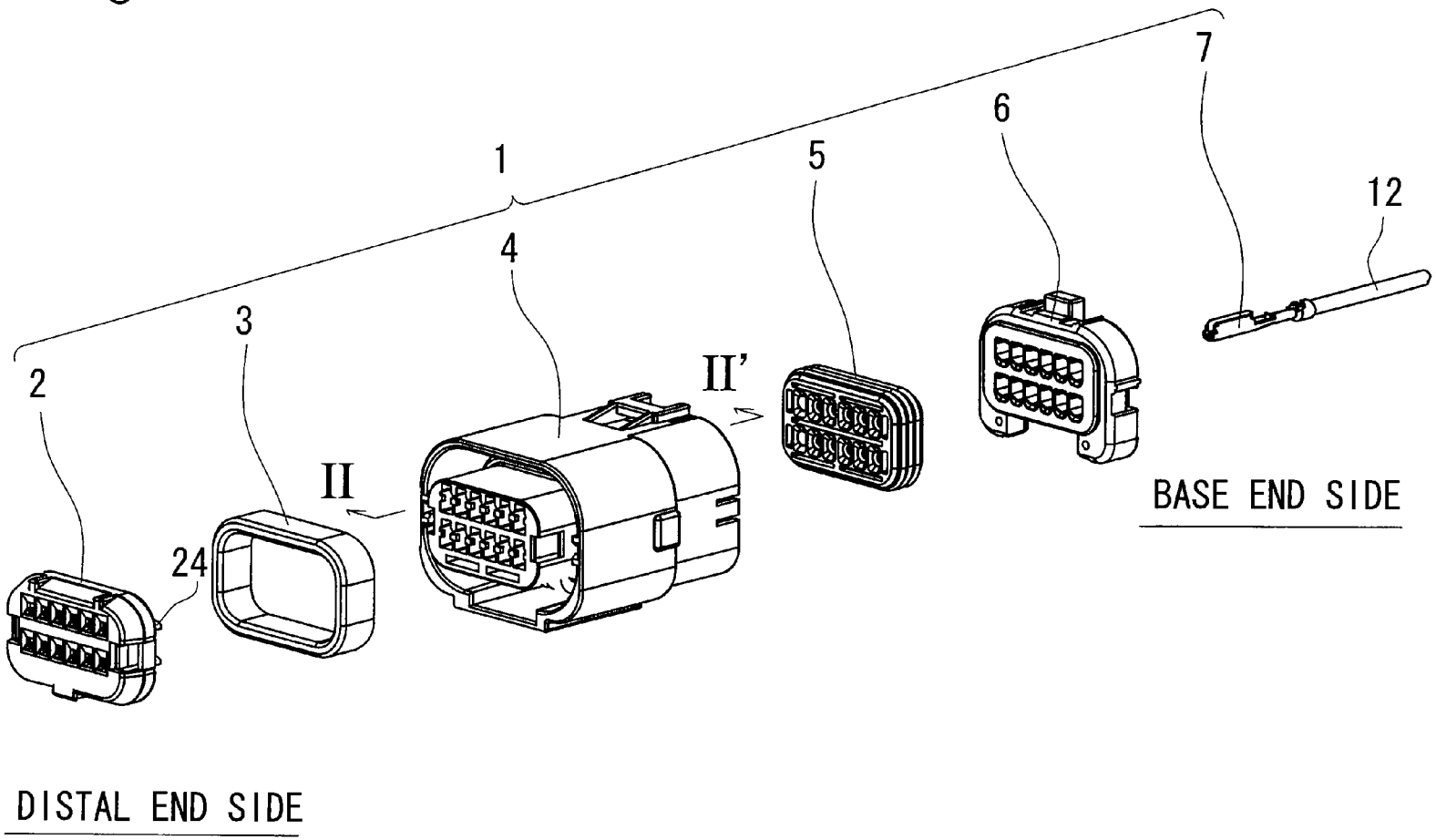
FIG. 1 is an exploded perspective view of a connector according to a first exemplary embodiment.

A connector 1 according to the first exemplary embodiment shown in FIG. 1 is used, for example, for wiring in electric systems in a four-wheel vehicle or a two-wheel vehicle. The connector 1 typically includes a front retainer 2, a sealing 3, a housing 4, a grommet 5, a rear cover 6, and a plurality of contacts 7 (receptacle contacts). In this specification, the term "distal end side" means "distal end side of the connector 1", as shown in FIG. 1, and the term "base end side" means "base end side of the connector 1" in principle.

Figure 2:
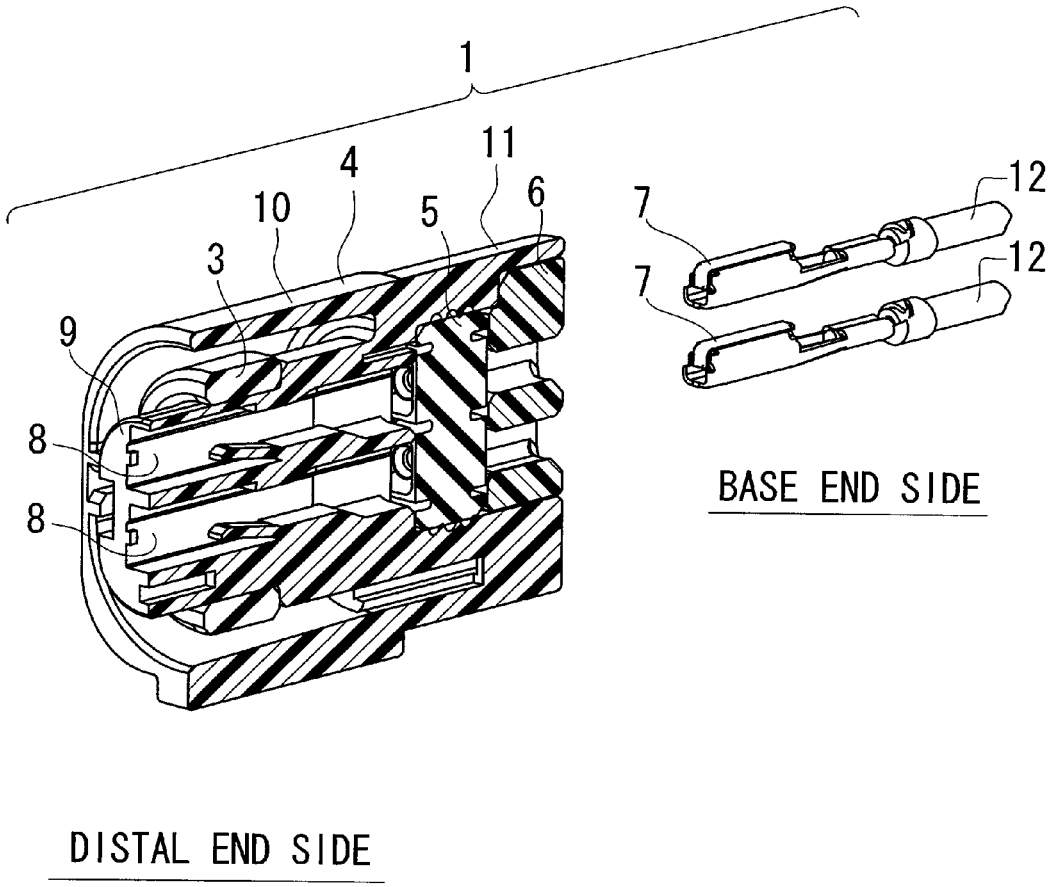
FIG. 2 is a cross-sectional perspective view of the connector taken along the line II-II' of FIG. 1.

The housing 4 holds the plurality of contacts 7. As shown in FIG. 2, the housing 4 includes a contact holding part 9, an outer cover 10, and a housing body 11. In the contact holding part 9, a cavity 8 is formed into which the contact 7 may be inserted. The outer cover 10 circularly surrounds the contact holding part 9. The housing body 11 contains the grommet 5 and the rear cover 6. The sealing 3 is attached to the outer periphery side of the contact holding part 9, and the front retainer 2 shown in FIG. 1 is attached to the distal end of the contact holding part 9. In FIG. 2, the sealing 3 prevents moisture and contaminants from intruding into the cavity 8 of the contact holding part 9 from the distal end side. The grommet 5 prevents moisture and contaminants from intruding into the cavity 8 of the contact holding part 9 from the base end side, and prevents an electric wire 12 connected to the contact 7 from being damaged by contact with the housing 4. The rear cover 6 retains the grommet 5 in the housing body 11.

(Contact 7)

Figure 3A:
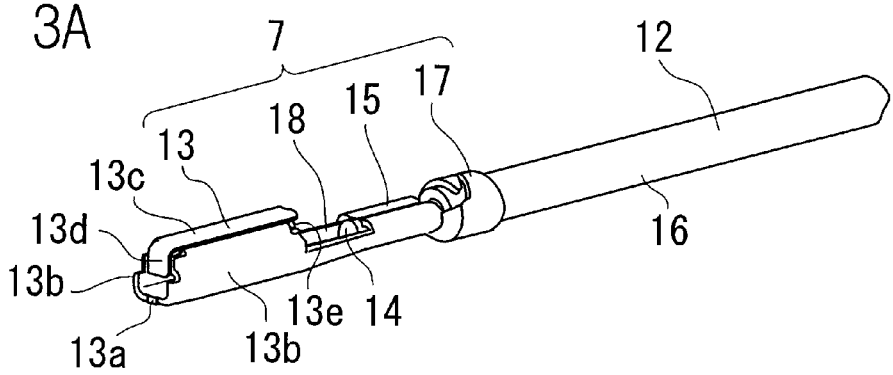
FIG. 3A is a perspective view of a contact.

Next, description will be made of the contact 7 with reference to FIGS. 3A and 3B. As shown in FIG. 3A, the contact 7 according to the first exemplary embodiment is formed by sheet metal working. The contact 7 includes a contact body 13 into which a tab of a male contact (not shown) is inserted, a conductor barrel 15 to contact a conductor 14 of the electric wire 12 to the contact 7, an insulation grip 17 to fix an insulator 16 of the electric wire 12 to the contact 7, and a connecting part 18 that connects the contact body 13 and the conductor barrel 15.

The contact body 13 has a substantially square tube, as shown in FIG. 3A. The contact body 13 includes a bottom wall part 13*a*, a pair of side wall parts 13*b*, a bead 13*c* that is opposed to the bottom wall part 13*a*, a distal end wall part 13*d* that is opposite to the insulation grip 17 with the bead 13*c* interposed therebetween, and a base end wall part 13*e* that is opposed to the distal end wall part 13*d*.

Figure 3B:
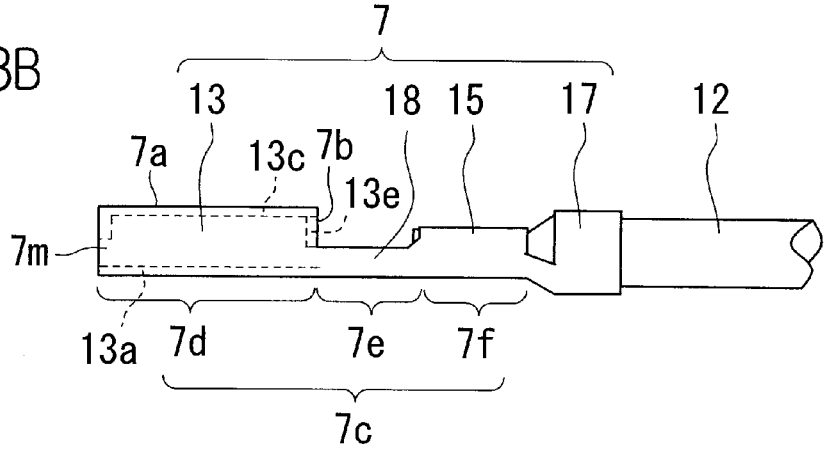
FIG. 3B is a schematic side view of the contact.

FIG. 3B schematically shows a side view of the contact 7, for the convenience of description. FIG. 3B shows a top surface 7*a*, a base end surface 7*b*, a bottom surface 7*c*, and a distal end 7*m* of the contact 7. The top surface 7*a* corresponds to the outer surface of the bead 13*c*. The base end surface 7*b* corresponds to the outer surface of the base end wall part 13*e*, and is substantially perpendicular to the longitudinal direction of the contact 7. The bottom surface 7*c* is formed of a bottom surface 7*d* of the contact body 13 (outer surface of the bottom wall part 13*a*), a bottom surface 7*e* of the connecting part 18, and a bottom surface 7*f* of the conductor barrel 15. In the first exemplary embodiment, the bottom surface 7*c* of the contact 7 has a plane shape without lance or recess, as shown in FIG. 3B.

(Contact Holding Part 9)

Figure 3C:
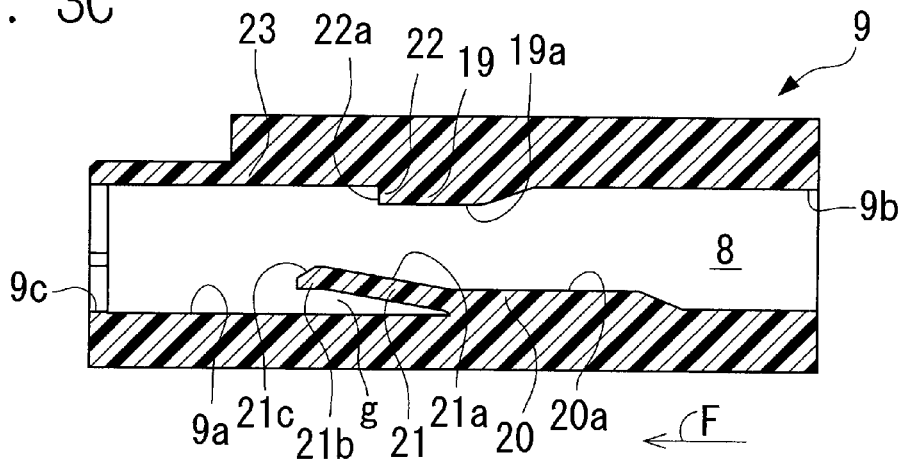
FIG. 3C is a partially cross-sectional view of a housing.
Figure 4A:
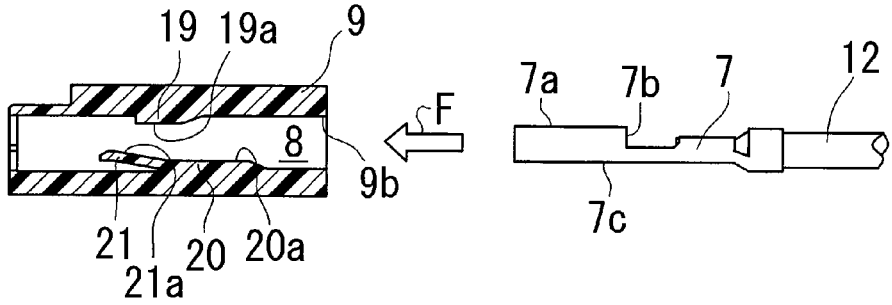
FIG. 4A shows a state before the contact is inserted into the housing.

Now, description will be made of the contact holding part 9 with reference to FIG. 3C. In FIG. 3C, an insertion direction F (contact insertion direction) means an insertion direction of the contact 7 into the cavity 8 as shown in FIG. 4A, for example.

As shown in FIG. 3C, the contact holding part 9 has a cavity 8 formed therein so as to allow the contact 7 to be inserted into the cavity 8. In an inner wall surface 9*a* of the contact holding part 9, an upper projected part 19 and a lower projected part 20 are formed. The upper projected part 19 and the lower projected part 20 are opposed with each other with the cavity 8 interposed therebetween. A pressing piece 21 is formed in a distal end side of the lower projected part 20. A base end side end part of the pressing piece 21 is connected to the lower projected part 20, and a distal end part 21*b* of the pressing piece 21 is a free end. In short, the pressing piece 21 is a cantilever that is supported by the lower projected part 20 and is extending in the distal end side. The pressing piece 21 is opposed to the upper projected part 19 with the cavity 8 interposed therebetween, as is similar to the lower projected part 20. In summary, the upper projected part 19 is opposed to both of the base end side end part of the pressing piece 21 and the distal end side end part of the lower projected part 20 with the cavity 8 interposed therebetween.

An upper guide surface 19*a* is formed in a wall surface in the side of the lower projected part 20 of the upper projected part 19. Further, a locking member 22 is formed in the distal end side end part of the upper projected part 19. This locking member 22 includes a locking wall surface 22*a* that is substantially perpendicular to the insertion direction F.

A first lower guide surface 20*a* is formed in a wall surface in the side of the upper projected part 19 of the lower projected part 20.

The pressing piece 21 moves the contact 7 inserted into the cavity 8 in a direction that is substantially perpendicular to the insertion direction F. The pressing piece 21 extends in the distal end side from the lower projected part 20 somewhat obliquely upward in an unloaded state shown in FIG. 3C. A second lower guide surface 21*a* is formed in a wall surface in the side of the upper projected part 19 of the pressing piece 21. Further, in the distal end part 21*b* of the pressing piece 21, a sloped surface 21*c* (guide surface) is formed that inclines obliquely downward toward the distal end side. A pressing piece gap g is formed between the pressing piece 21 extending somewhat obliquely upward and the inner wall surface 9*a* of the contact holding part 9.

An abut part (reception part) 23 is formed in a wall part of the contact holding part 9 in the distal end side of the upper projected part 19. The contact 7 abuts the abut part 23 due to the movement by the pressing piece 21. More specifically, the contact body 13 of the contact 7 abuts the abut part 23 due to the movement by the pressing piece 21. Now, "abut" here means "contact". The abut part 23 is adjacent to the upper projected part 19 in the insertion direction F, and is located at the distal end side of the upper projected part 19. The locking member 22 locks the contact 7 that abuts the abut part 23 to prevent the contact 7 from being pulled out in the direction opposite to the insertion direction F, as shown in FIG. 4C.

In addition, the contact holding part 9 has a contact insertion opening 9*b* to insert the contact 7 into the cavity 8, and a front opening 9*c* to insert the tab of the male contact (not shown) and the retainer piece 24 (supporting piece) of the front retainer 2 shown in FIG. 1 into the cavity 8 in the direction opposite to the insertion direction F.

(Insertion of Contact 7 into Cavity 8)

Next, insertion of the contact 7 into the cavity 8 will be described with reference to FIGS. 4A, 4B, and 4C. As shown in FIG. 4A and so on, when the contact 7 is inserted into the cavity 8, the front retainer 2 shown in FIG. 1 is removed from the housing 4 in advance. In other words, the contact 7 is first inserted into the cavity 8, and thereafter the front retainer 2 is attached to the housing 4.

Figure 4B:
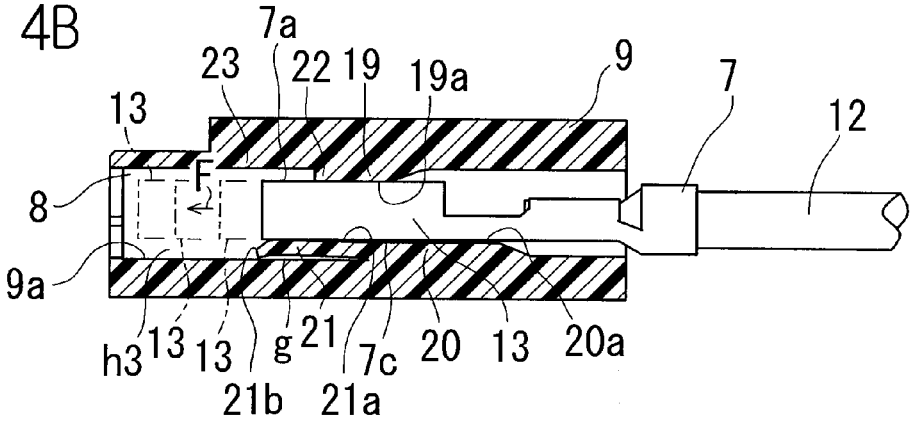
FIG. 4B shows a state in which the contact is being inserted into the housing.
Figure 4C:
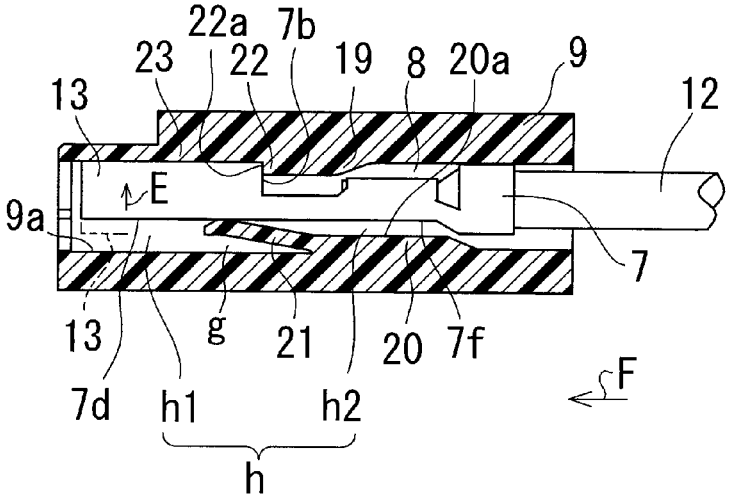
FIG. 4C shows a state after the contact is inserted into the housing.

First, as shown in FIGS. 4A and 4B, the contact 7 is gradually inserted into the cavity 8 through the contact insertion opening 9*b* so that the top surface 7*a* of the contact 7 contacts with the upper projected part 19 of the contact holding part 9 and the bottom surface 7*c* of the contact 7 contacts with the pressing piece 21 and the lower projected part 20 of the contact holding part 9.

Then, the bottom surface 7*c* of the contact 7 first contacts with the first lower guide surface 20*a* of the lower projected part 20, and the contact 7 is guided by the first lower guide surface 20*a* of the lower projected part 20. Next, the top surface 7*a* of the contact 7 contacts with the upper guide surface 19*a* of the upper projected part 19, and the contact 7 is guided by the upper guide surface 19*a* of the upper projected part 19. In summary, at this time, the contact 7 is guided while being sandwiched between the first lower guide surface 20*a* of the lower projected part 20 and the upper guide surface 19*a* of the upper projected part 19.

When the contact 7 is further inserted into the cavity 8, the bottom surface 7*c* of the contact 7 contacts with the second lower guide surface 21*a* of the pressing piece 21, and the pressing piece 21 is pushed down with insertion of the contact 7 as shown in FIG. 4B, resulting in substantial disappearance of the pressing piece gap g. When the pressing piece 21 is pushed down by the contact 7 as shown in FIG. 4B, the pressing piece 21 biases the contact body 13 upwardly, which is the direction that is substantially perpendicular to the insertion direction F, by a self elastic restoring force. This self elastic restoring force is received by the upper projected part 19 through the contact body 13.

When the contact 7 is further inserted into the cavity 8, as shown by two-dot chain lines in FIG. 4B, the relation shown in FIG. 4B, that the top surface 7*a* of the contact 7 is opposed to the upper guide surface 19*a* of the upper projected part 19, is cancelled. Then, the contact 7 moves by the self elastic restoring force in a moving direction E, which is the direction that is substantially perpendicular to the insertion direction F, as shown in FIG. 4C. As a result, the contact body 13 abuts the abut part 23 as shown in FIG. 4C, and the pressing piece gap g which is between the pressing piece 21 and the inner wall surface 9*a* of the contact holding part 9 appears again. When the contact body 13 abuts the abut part 23, the base end surface 7*b* of the contact 7 is opposed to the locking wall surface 22*a* of the locking member 22 in the insertion direction F, the base end surface 7*b* of the contact 7 abuts the locking wall surface 22*a* of the locking member 22, whereby the contact 7 is locked by the locking member 22.

As shown in FIG. 4C, due to the movement of the contact 7 in the moving direction E, a gap h is formed between the bottom surface 7*c* of the contact 7 (see FIG. 4B) and the inner wall surface 9*a* of the contact holding part 9. Hereinafter, the gap h which is in the back side of the pressing piece 21 in the insertion direction F is called back-side gap h1 (gap, first gap), and the gap h which is in the front side of the pressing piece 21 in the insertion direction F is called front-side gap h2 (second gap). The back-side gap h1 is formed in the opposite side of the abut part 23 with the contact body 13 interposed therebetween. The back-side gap h1 is formed between the bottom surface 7*c* of the contact 7 and the inner wall surface 9*a* of the contact holding part 9. The front-side gap h2 is formed between the contact 7 and the lower projected part 20. The front-side gap h2 is formed between the bottom surface 7*c* of the contact 7 and the first lower guide surface 20*a* of the lower projected part 20. More specifically, in the first exemplary embodiment, the back-side gap h1 is formed as a result of a small gap h3 (see FIG. 4B) which is between the bottom surface 7*c* of the contact 7 and the inner wall surface 9*a* of the contact holding part 9 being larger due to the movement. The gap h3 already exists before the movement of the contact 7 in the moving direction E.

Referring now to FIGS. 4B and 4C, a compressed state (first state) and a half-compressed state (second state) of the pressing piece 21 will be described. The compressed state of the pressing piece 21 means the state before the movement of the contact 7 in the moving direction E. Specifically, the compressed state of the pressing piece 21 means, as shown in FIG. 4B, the state in which the pressing piece 21 is pushed down by the contact 7, the distal end part 21*b* is pushed down towards the inner wall surface 9*a* of the contact holding part 9, and considerable self elastic restoring force is stored in the pressing piece 21. Hence, the pressing piece 21 shown in FIG.

4A is not in the compressed state but in the unloaded state. Meanwhile, the half-compressed state of the pressing piece 21 means the state after the movement of the contact 7 in the moving direction E. More specifically, the half-compressed state of the pressing piece 21 is, as shown in FIG. 4C, the state after the pressing piece 21 pushes up the contact 7 and the pressing piece gap g which is once almost disappeared appears again.

Referring next to FIGS. 4B and 4C, description will be made of the movement incompletion position (first position) and the movement completion position (second position, fitting state) of the contact 7. The movement incompletion position of the contact 7 means a position of the contact 7 before the movement in the moving direction E. More specifically, as illustrated by solid lines and two-dot chain lines in FIG. 4B, the movement incompletion position of the contact 7 means the position of the contact 7 when at least a part of the contact 7 is sandwiched between the upper projected part 19 and the pressing piece 21 in the direction perpendicular to the insertion direction F. When the contact 7 is in the movement incompletion position, the contact 7 is not completely fitted into the housing 4. This state of the contact 7 is called half-fitting state. On the other hand, the movement completion position of the contact 7 means the position of the contact 7 after the movement in the moving direction E. More specifically, the movement completion position of the contact 7 is the position of the contact 7 when the contact body 13 abuts the abut part 23, as shown by solid lines in FIG. 4C. When the contact 7 is in the movement completion position, the contact 7 is completely fitted into the housing 4. This state of the contact 7 is called fitting state.

(Front Retainer 2)

Next, description will be made of the front retainer 2 with reference to FIGS. 5A, 5B, and 5C.

Figure 5A:
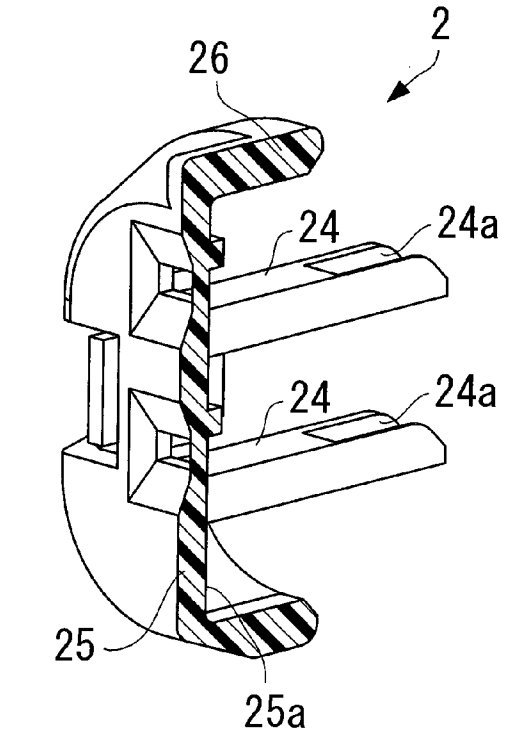
FIG. 5A is a cross-sectional perspective view of a front retainer.
Figure 5B:
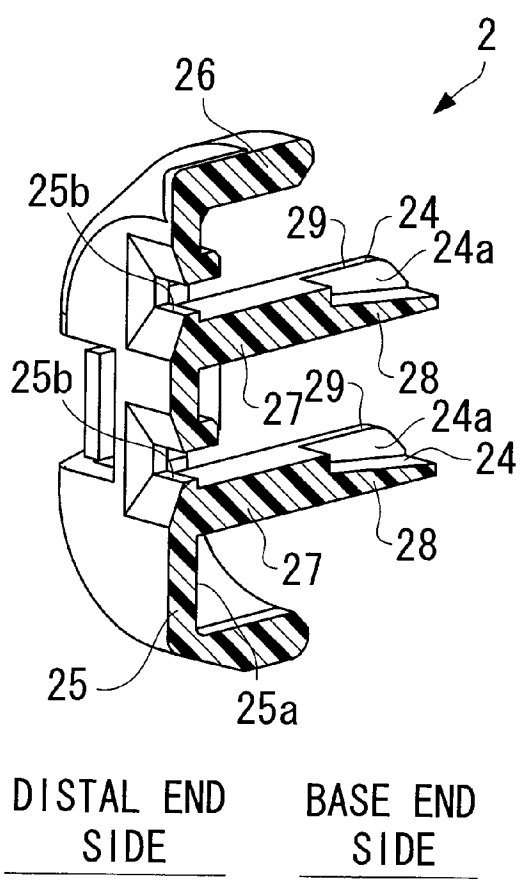
FIG. 5B is a cross-sectional perspective view of the front retainer.

As shown in FIG. 5A, the front retainer 2 includes a front panel 25 that covers the contact holding part 9 of the housing 4 shown in FIG. 2 from the distal end side, a circular retainer cover 26 that extends from the outer periphery of the front panel 25 in the base end side, and a plurality of retainer pieces 24 that extend from the base end side wall surface 25*a* of the front panel 25 in the base end side. As shown in FIG. 5B, in the front panel 25, a pair of tab insertion holes 25*b* are formed in each retainer piece 24 so that the tabs of the male contact may be inserted into the tab insertion holes 25*b*.

Figure 5C:
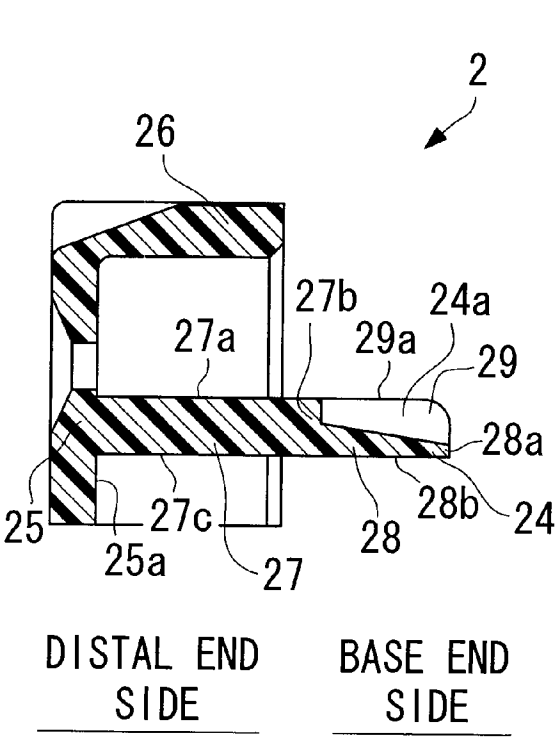
FIG. 5C is a partially cross-sectional view of the front retainer.
Figure 6A:
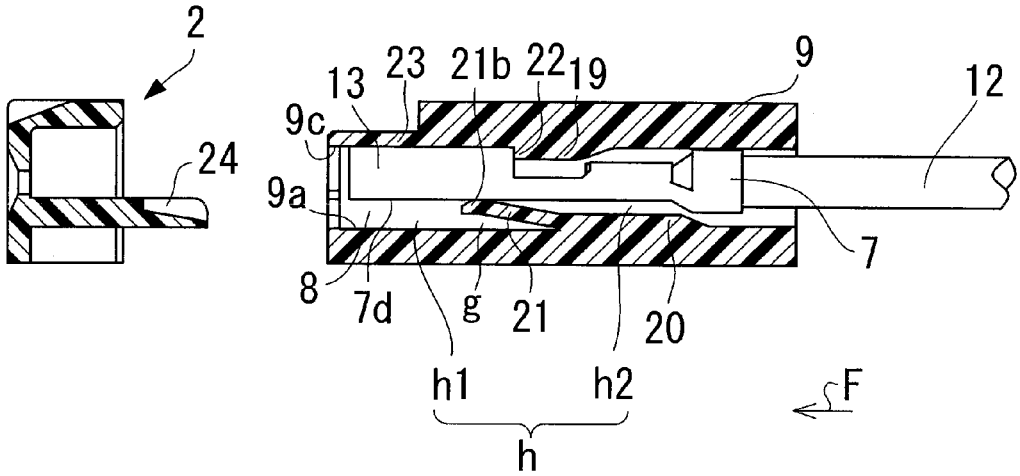
FIG. 6A shows a state before the front retainer is attached to the housing.
Figure 6B:
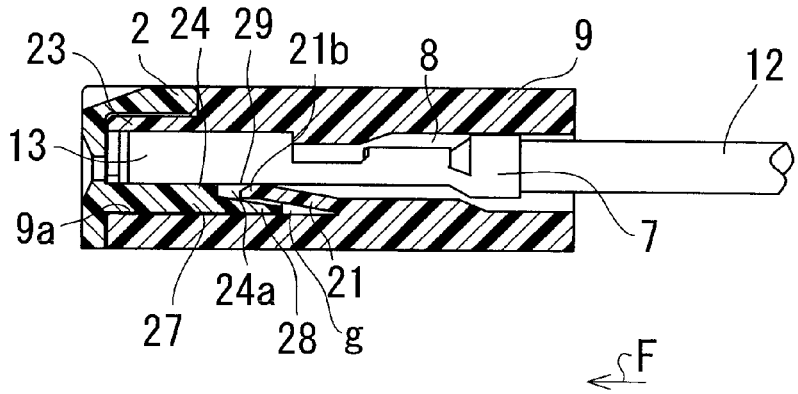
FIG. 6B shows a state after the front retainer is attached to the housing.

Each of the retainer pieces 24 may be inserted into the cavity 8 in the direction opposite to the insertion direction F, as shown in FIGS. 6A and 6B. As shown in FIGS. 5B and 5C, each of the retainer pieces 24 includes a prismatic part 27, a tapered part 28 (pressing piece state sensing part), and a pair of reinforced wall parts 29 that sandwich the tapered part 28.

As shown in FIG. 5C, the prismatic part 27 is formed to extend in the base end side from a base end side wall surface 25*a* of the front panel 25, and includes a first supporting surface 27*a*. The tapered part 28 is formed to extend in the base end side from a distal end part 27*b* of the prismatic part 27, and is gradually tapered towards a distal end part 28*a*. A bottom surface 27*c* of the prismatic part 27 and a bottom surface 28*b* of the tapered part 28 are formed on the same plane. Each of the reinforced wall parts 29 includes a second supporting surface 29*a*. The first supporting surface 27*a* and the second supporting surface 29*a* are formed on the same plane. A pair of reinforced wall parts 29 and the tapered part 28 form a groove 24*a*, as shown in FIGS. 5A, 5B, and 5C.

(Insertion of Retainer Piece 24 into Cavity 8)

Referring next to FIGS. 6A and 6B, the insertion of the retainer piece 24 into the cavity 8 will be described. In this example, the contact 7 is completely inserted into the cavity 8 in advance, i.e., the contact 7 is moved from the movement incompletion position shown in FIG. 4B to the movement completion position shown in FIG. 4C, and the pressing piece 21 is switched from the compressed state shown in FIG. 4B to the half-compressed state shown in FIG. 4C.

As shown in FIGS. 6A and 6B, the retainer piece 24 of the front retainer 2 is inserted into the cavity 8 through the front opening 9*c*. In summary, the retainer piece 24 of the front retainer 2 is inserted into the back-side gap h1 of the gap h formed in the cavity 8. Then, the back-side gap h1 shown in FIG. 6A substantially disappears by the prismatic part 27 of the retainer piece 24 as shown in FIG. 6B. Thus, the contact body 13 of the contact 7 is sandwiched between the abut part 23 and the prismatic part 27 in a direction substantially perpendicular to the insertion direction F, whereby looseness of the contact 7 in the cavity 8 may be effectively suppressed. Note that, in this case, the distal end part 21*b* of the pressing piece 21 which is in the half-compressed state is contained in the groove 24*a* of the retainer piece 24 without interrupting the retainer piece 24 of the front retainer 2. In summary, the tapered part 28 of the retainer piece 24 is contained in the pressing piece gap g formed between the pressing piece 21 and the inner wall surface 9*a* of the contact holding part 9.

Figure 7A:
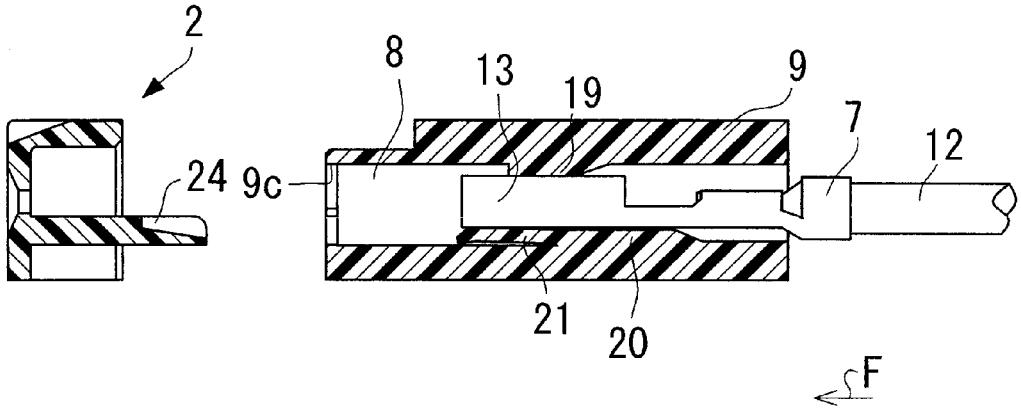
FIG. 7A shows a state before the front retainer is attached to the housing.
Figure 7B:
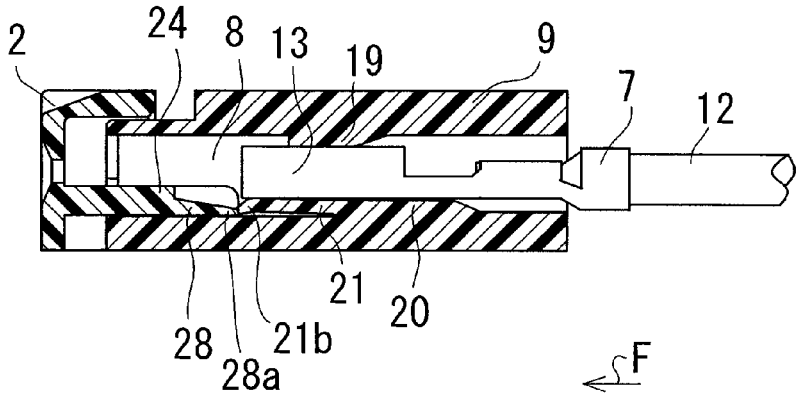
FIG. 7B shows a state in which the front retainer bumps into a pressing piece.

Referring next to FIGS. 7A and 7B, the insertion of the retainer piece 24 into the cavity 8 will be described. It is assumed that the contact 7 is not completely inserted into the cavity 8, which means the contact 7 is in the movement incompletion position shown in FIG. 4B, and the pressing piece 21 is in the compressed state shown in FIG. 4B. As will be clear by comparing FIG. 6B with FIG. 7B, the trajectory of the retainer piece 24 inserted into the cavity 8 is substantially the same.

More specifically, as shown in FIGS. 7A and 7B, the retainer piece 24 of the front retainer 2 is inserted into the cavity 8 through the front opening 9*c*. Then, as shown in FIG. 7B, the distal end part 28*a* of the tapered part 28 of the retainer piece 24 bumps into the distal end part 21*b* of the pressing piece 21 which is in the compressed state, which inhibits further insertion of the retainer piece 24 into the cavity 8. Accordingly, the distal end part 28*a* of the tapered part 28 of the retainer piece 24 is stopped at the incomplete insertion position, which allows an assembler of the connector 1 to find that the contact 7 is in the movement incompletion position. In this case, the assembler pulls out the retainer piece 24 of the front retainer 2 from the cavity 8, again strongly pushes all the contacts 7 inserted into the cavity 8, so as to try to insert the retainer piece 24 into the cavity 8 again.

(Main Points)

(1) As discussed above, in the first exemplary embodiment, the connector 1 is formed as follows, as shown in FIGS. 1 to 6B. The connector 1 includes the contact 7, the housing 4 having a cavity 8 into which the contact 7 may be inserted formed therein to retain the contact 7 inserted into the cavity 8, and the retainer piece 24 that may be inserted into the cavity 8 in the direction opposite from the insertion direction F. The housing 4 includes the pressing piece 21 that moves the contact 7 inserted into the cavity 8 in the moving direction E which is the direction substantially perpendicular to the insertion direction F, the abut part 23 that the contact 7 abuts due to the movement of the pressing piece 21, and the locking member 22 that locks the contact 7 abutted to the abut part 23. The retainer piece 24 is inserted into the back-side gap h1 formed between the contact 7 and the inner wall surface 9*a* of the housing 4 due to the movement of the pressing piece 21, as shown in FIGS. 6A and 6B. According to the structure above, as shown in FIGS. 6A and 6B, the back-side gap h1 formed between the contact 7 and the inner wall surface 9*a* of the housing 4 disappears by the retainer piece 24 due to the movement of the pressing piece 21, whereby looseness of the contact 7 in the cavity 8 may be effectively suppressed.

(2) Further, the retainer piece 24 includes the tapered part 28. The tapered part 28 abuts the pressing piece 21 which is in the compressed state before the movement of the contact 7 as shown in FIG. 7B, and is contained in the pressing piece gap g which is formed between the inner wall surface 9*a* of the contact holding part 9 and the pressing piece 21 which is in the half-compressed state after the movement of the contact 7 as shown in FIG. 6B. In summary, as shown in FIGS. 413 and 4C, the contact 7 is not locked by the locking member 22 unless it moves by the pressing piece 21 and abuts the abut part 23. Further, the state of the pressing piece 21 is changed from the compressed state to the half-compressed state by the movement. Hence, as shown in FIGS. 6B and 7B, according to the structure above, when the retainer piece 24 is inserted into the cavity 8, the state of the pressing piece 21 is sensed by checking whether the tapered part 28 bumps into the pressing piece 21. By sensing the state of the pressing piece 21, it is judged whether the contact 7 is moved or not. By judging whether the contact 7 is moved or not, it is judged whether the contact 7 may be locked by the locking member 22. In short, according to the structure above, when the retainer piece 24 is inserted into the cavity 8, it is judged whether the contact 7 may be locked by the locking member 22 by judging whether the tapered part 28 bumps into the pressing piece 21, so as to judge the so-called half-fitting state of the contact 7.

Further, the tapered part 28 is formed so that it may be inserted into the pressing piece gap g between the pressing piece 21 which is in the half-compressed state after the movement of the contact 7 and the inner wall surface 9*a* of the housing 4, as shown in FIG. 6B. According to this structure, the tapered part 28 that passes by the pressing piece 21 which is in the half-compressed state after the movement of the contact 7 may be made simple in structure.

Second Exemplary Embodiment

A second exemplary embodiment of the present invention will be described with reference to FIGS. 8A to 11. In the second exemplary embodiment, only the difference from the first exemplary embodiment is mainly described and overlapping description is omitted as appropriate. Reference symbols that are identical to those in the first exemplary embodiment denote identical or similar components.

(Front Retainer 2)

Figure 8B:
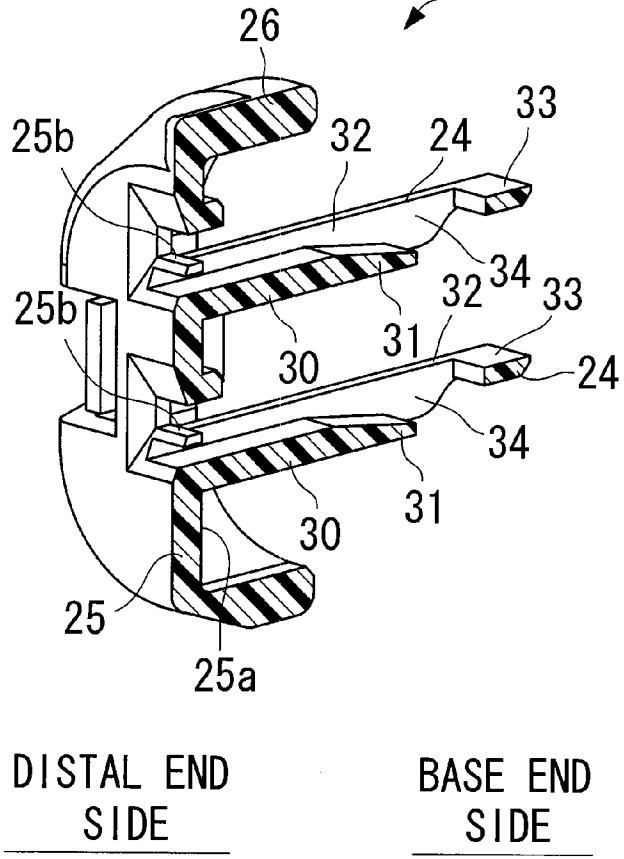
FIG. 8B is a cross-sectional perspective view of the front retainer according to the second exemplary embodiment.
Figure 8A:
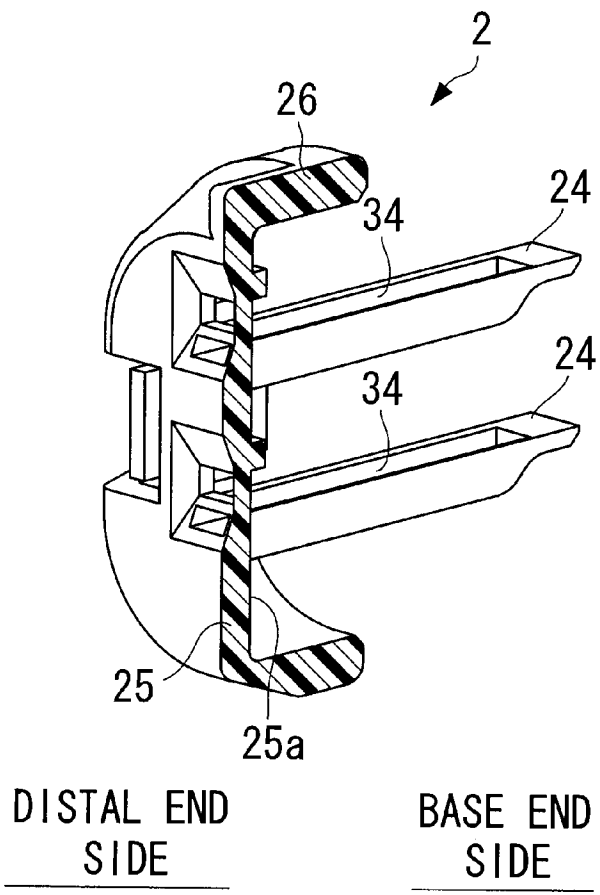
FIG. 8A is a cross-sectional perspective view of a front retainer according to a second exemplary embodiment.

In the second exemplary embodiment, the retainer piece 24 includes a prismatic part 30, a tapered part 31, a pair of supporting side wall parts 32 that sandwich the prismatic part 30 and the tapered part 31, and an extruding part 33 (contact position sensing part, second supporting part), as shown in FIG. 8B. The extruding part 33 is formed in the base end side of the tapered part 31 so that it is formed somewhat apart from the tapered part 31. In summary, a pressing piece contain space 34 is formed between the tapered part 31 and the extruding part 33, as shown in FIGS. 8A and 8B.

Figure 8C:
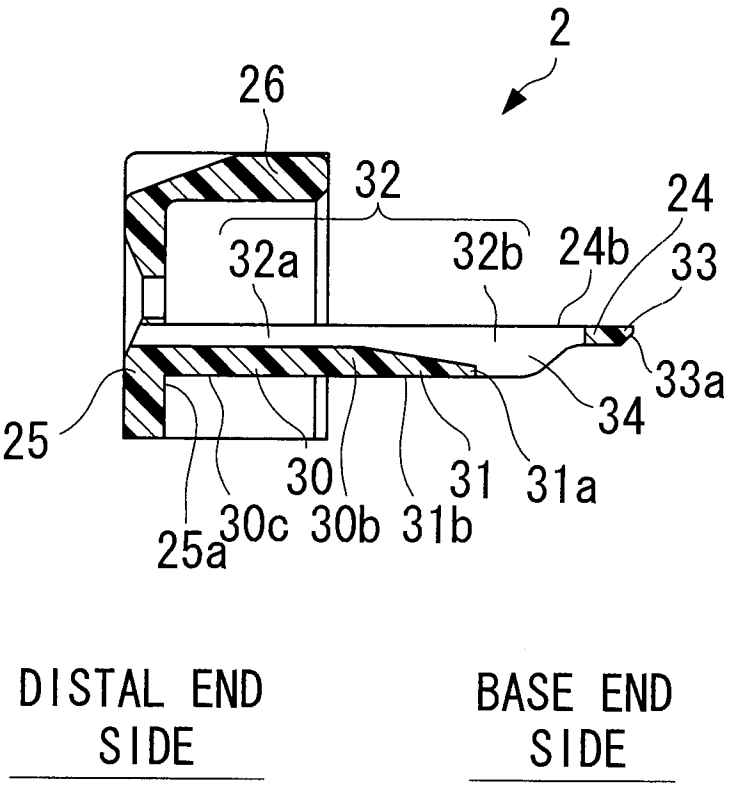
FIG. 8C is a partially cross-sectional view of the front retainer.

As shown in FIG. 8C, the prismatic part 30 is formed to extend in the base end side from the base end side wall surface 25*a* of the front panel 25. The tapered part 31 is formed to extend in the base end side from a distal end part 30*h* of the prismatic part 30, and is gradually tapered towards a distal end part 31*a*. A bottom surface 30*c* of the prismatic part 30 and a bottom surface 31*b* of the tapered part 31 are formed on the same plane. Each of the supporting side wall parts 32 is composed of a first supporting side wall part 32*a* (first supporting part) which is in the distal end side than the tapered part 31, and a second supporting side wall part 32*h* which is positioned between the prismatic part 30 and the extruding part 33. The extruding part 33 is formed near an upper end 24*b* of the retainer piece 24 in FIG. 5C so as to be able to ride over the pressing piece 21 which is in the compressed state as shown in FIGS. 9C and 11C. Further, the extruding part 33 includes a sloped surface 33*a* that is inclined so as to be made closer to the bottom surface 31*b* of the tapered part 31 towards the base end side wall surface 25*a*. This sloped surface 33*a* is formed so that it may be opposed to the sloped surface 21*c* of the distal end part 21*b*, as shown in FIGS. 3C and 9B.

(Insertion of Retainer Piece 24 into Cavity 8)

Referring next to FIGS. 9A to 9D, the insertion of the retainer piece 24 into the cavity 8 will be described. In this example, the contact 7 is completely inserted into the cavity 8 in advance, i.e., the contact 7 is moved from the movement incompletion position shown in FIG. 4B to the movement completion position shown in FIG. 4C, and the pressing piece 21 is switched from the compressed state shown in FIG. 4B to the half-compressed state shown in FIG. 4C.

Figure 9A:
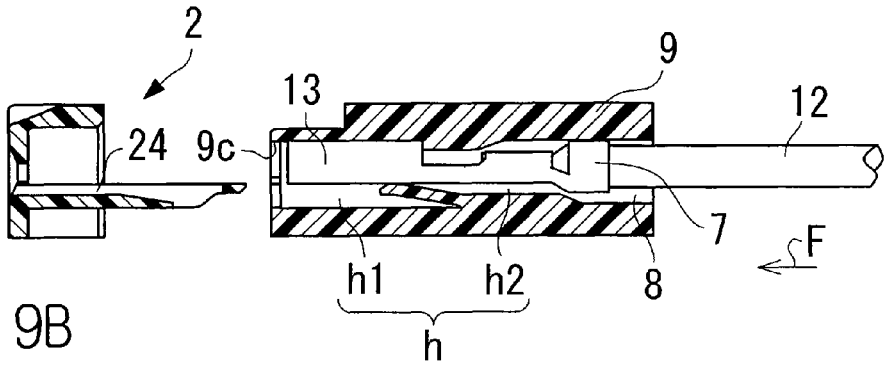
FIG. 9A shows a state before the front retainer is attached to a housing.
Figure 9B:
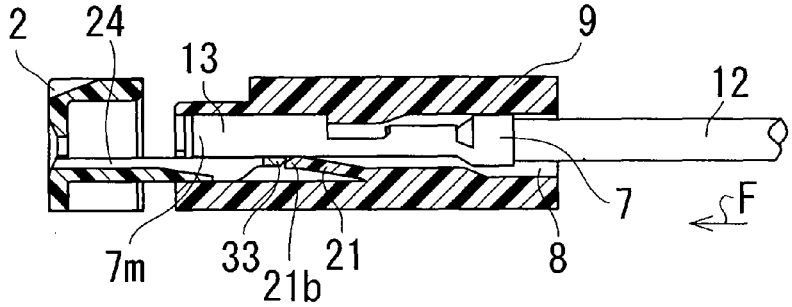
FIG. 9B shows a state in which the front retainer is being attached to the housing.
Figure 9C:
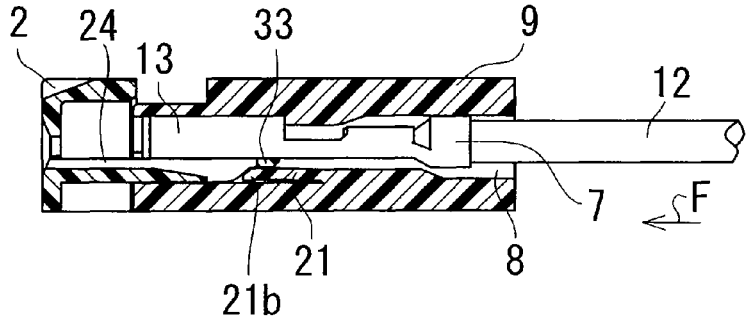
FIG. 9C shows a state in which the front retainer is being attached to the housing.

As shown in FIGS. 9A and 9B, the retainer piece 24 of the front retainer 2 is inserted into the cavity 8 through the front opening 9*c*. Specifically, the retainer piece 24 of the front retainer 2 is inserted into the back-side gap h1 of the gap h formed in the cavity 8. At this time, as shown in FIG. 9B, the extruding part 33 of the retainer piece 24 passes the distal end 7*m* of the contact 7 which is completely fitted to the contact holding part 9, and is inserted into the back-side gap h1. Immediately after that, as shown in FIG. 9B, the extruding part 33 of the retainer piece 24 bumps into the distal end part 21*b* of the pressing piece 21. At this time, as shown in FIG. 8C, the sloped surface 33*a* is formed in the extruding part 33, and the sloped surface 21*c* is formed in the distal end part 21*b* of the pressing piece 21 as shown in FIG. 3C. Thus, when the retainer piece 24 is further inserted into the cavity 8 from the state shown in FIG. 9B, the sloped surface 33*a* shown in FIG. 8C contacts with the sloped surface 21*c* shown in FIG. 3C, the pressing piece 21 is in the compressed state in which it is pushed down by the extruding part 33 as shown in FIG. 9C, and the extruding part 33 is inserted between the contact 7 and the pressing piece 21.

Figure 9D:
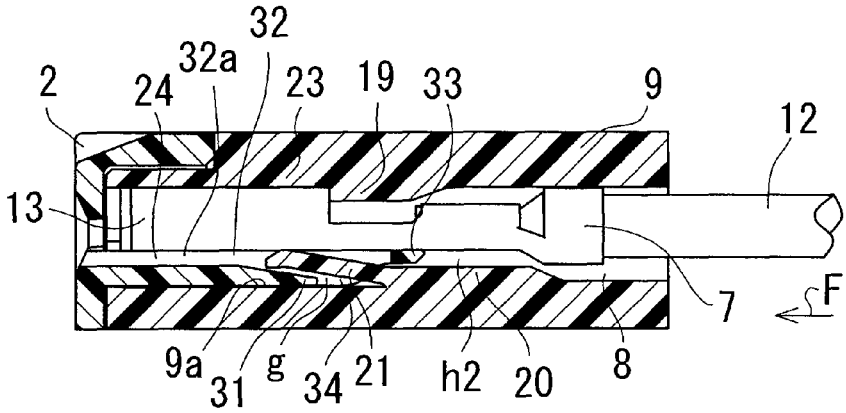
FIG. 9D shows a state after the front retainer is attached to the housing.

When the retainer piece 24 is further inserted into the cavity 8, the extruding part 33 completely rides over the pressing piece 21 as shown in FIG. 9D, and is inserted into the front-side gap h2 formed between the contact 7 and the lower projected part 20. Further, the pressing piece 21 is contained in the pressing piece contain space 34, and the state of the pressing piece 21 is substantially the same as the state of the pressing piece 21 shown in FIGS. 9A and 9B.

Figure 10:
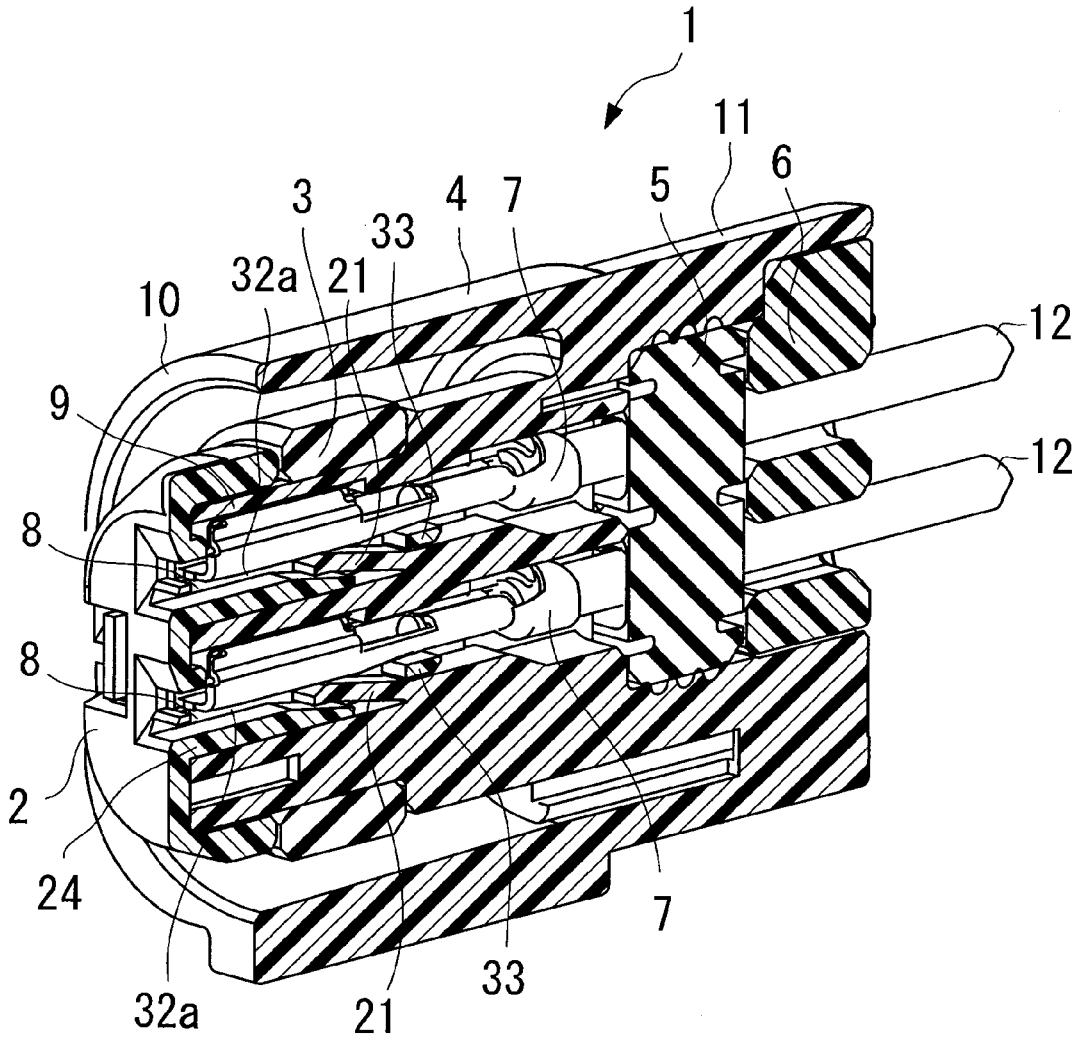
FIG. 10 is a cross-sectional perspective view of a connector after the front retainer is attached to the housing.

Just for reference, FIG. 10 shows a cross-sectional perspective view corresponding to FIG. 9D.

Figure 11A:
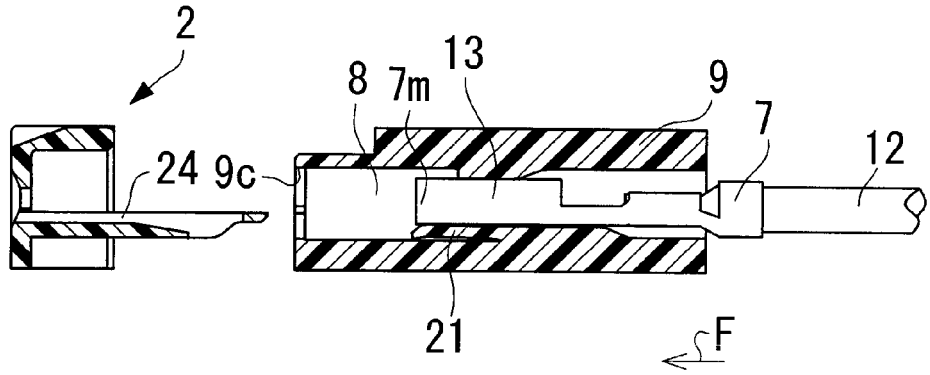
FIG. 11A shows a state before the front retainer is attached to the housing.
Figure 11B:
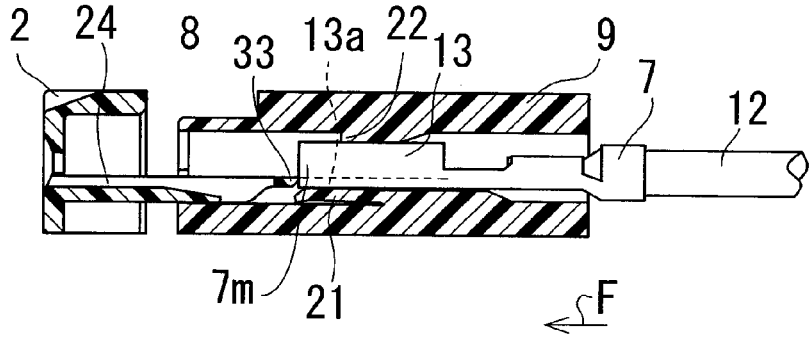
FIG. 11B shows a state in which the front retainer bumps into a contact.
Figure 11C:
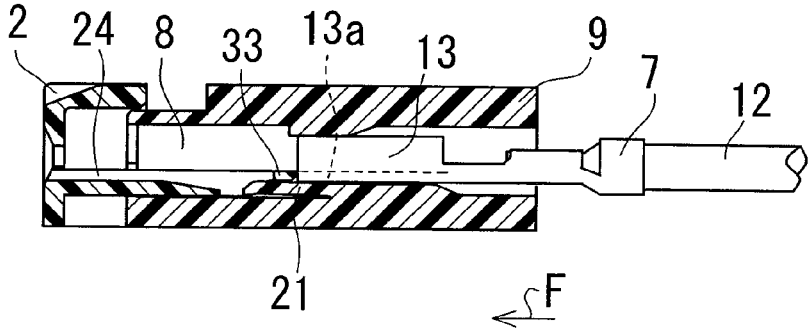
FIG. 11C shows a state in which the contact is pushed out from the housing by the front retainer.

Referring next to FIGS. 11A to 11C, the insertion of the retainer piece 24 into the cavity 8 will be described. In this example, the contact 7 is not completely inserted into the cavity 8, i.e., the contact 7 is in the movement incompletion position shown in FIG. 4B, and the pressing piece 21 is in the compressed state shown in FIG. 4B. As will be clear by comparing FIG. 9B with FIG. 11B, the trajectory of the retainer piece 24 inserted into the cavity 8 is substantially the same.

Specifically, as shown in FIGS. 11A and 11B, the retainer piece 24 of the front retainer 2 is inserted into the cavity 8 through the front opening 9*c*. Then, as shown in FIG. 11B, the extruding part 33 of the retainer piece 24 bumps into the bottom wall part 13*a* of the contact body 13 of the contact 7 shown in FIGS. 3A and 3B. In other words, the extruding part 33 of the retainer piece 24 abuts the distal end 7*m* of the contact 7. When the retainer piece 24 is further inserted into the cavity 8, since the contact 7 is not locked by the locking member 22 at all, as shown in FIG. 11B, the contact 7 is pushed by the extruding part 33 of the retainer piece 24, and as shown in FIG. 11C, pushed to the direction opposite to the insertion direction F. Accordingly, by visually checking the phenomenon that the contact 7 is pushed out from the cavity 8, the assembler of the connector 1 recognizes that the contact 7 is in the movement incompletion position. In this case, the assembler pulls out the retainer piece 24 of the front retainer 2 from the cavity 8, strongly pushes all the contacts 7 inserted into the cavity 8 again, and tries to insert the retainer piece 24 into the cavity 8.

(Main Points)

(3) As discussed above, in the second exemplary embodiment, the connector 1 is formed as follows. In the retainer piece 24, the extruding part 33 is formed. As shown in FIG. 8A to FIG. 11C, the extruding part 33 abuts the distal end 7*m* of the contact 7 when the contact 7 is in the half-fitting state in which the contact 7 is not completely fitted to the contact holding part 9, and passes the distal end 7*m* of the contact 7 and is inserted into the front-side gap h2 when the contact 7 is completely fitted to the contact holding part 9. According to the structure above, when the retainer piece 24 is inserted into the cavity 8, it is checked if the extruding part 33 abuts the distal end 7*m* of the contact 7 and the contact 7 is extruded in the direction opposite to the insertion direction F, thereby checking whether the contact 7 may be locked by the locking member 22 (fitting state).

(4) Further, the retainer piece 24 includes, as shown in FIG. 9A and FIG. 9D, the first supporting side wall part 32*a* and the extruding part 33. The first supporting side wall part 32*a* is contained in the back-side gap h1 which is the gap h in the back side than the pressing piece 21 in the insertion direction F, the gap h formed between the inner wall surface 9*a* of the housing 4 and the contact 7 due to the movement by the pressing piece 21. The extruding part 33 is contained in the front-side gap h2 which is the gap h in the front side than the pressing piece 21 in the insertion direction F. According to the structure above, in the insertion direction F, the retainer piece 24 is widely contained in the gap h formed between the contact 7 and the inner wall surface 9*a* of the housing 4 due to the movement by the pressing piece 21, whereby looseness of the contact 7 in the cavity 8 may further be effectively suppressed.

(5) As shown in FIGS. 3C, 8C, 9B, and 9C, the sloped surface 33*a* and the sloped surface 21*c* are formed in the extruding part 33 of the retainer piece 24 and the pressing piece 21, respectively, so as to retract the pressing piece 21 away from the contact 7 when the extruding part 33 passes between the contact 7 and the pressing piece 21 in the direction opposite to the insertion direction F. According to the structure above, when the extruding part 33 passes between the contact 7 and the pressing piece 21, the pressing piece 21 tends to actively retract away from the contact 7, whereby the extruding part 33 is able to smoothly pass between the contact 7 and the pressing piece 21.

Although the sloped surface 33*a* and the sloped surface 21*c* are formed in the extruding part 33 of the retainer piece 24 and the pressing piece 21, respectively, in the second exemplary embodiment, the sloped surface 33*a* or the sloped surface 21*c* may be formed in any one of the extruding part 33 and the pressing piece 21.

(6) Further, in the retainer piece 24, as shown in FIGS. 8B, 8C, and 9D, the tapered part 31 contained in the pressing piece gap g formed between the pressing piece 21 and the inner wall surface 9*a* of the contact holding part 9 is formed. According to the structure as above, the pressing piece 21 may be prevented from deforming in the direction away from the contact 7, whereby looseness of the contact 7 in the cavity 8 may be effectively suppressed.

(7) Further, in the retainer piece 24, as shown in FIGS. 9A and 9D, the pressing piece contain space 34 that contains the pressing piece 21 between the first supporting side wall part 32*a* and the extruding part 33 is formed so that the state of the pressing piece 21 before the retainer piece 24 is inserted into the cavity 8 is substantially the same to the state of the pressing piece 21 after the retainer piece 24 is inserted into the cavity 8. According to the structure above, the compressed state which is occurred upon the movement due to the insertion is cancelled in the pressing piece contain space 34, thereby mitigating the stress without producing unnecessary load to the pressing piece.

If the pressing piece 21 is in the compressed state and the stress inside the pressing piece 21 is kept to be increased by inserting the retainer piece 24 into the cavity 8, the pressing piece 21 does not recover to the half-compressed state shown in FIG. 9A after the retainer 24 is pulled out from the cavity 8 due to so-called stress relaxation phenomenon. Meanwhile, the pressing piece contain space 34 suppresses the increase in the stress inside the pressing piece 21 due to the insertion of the retainer piece 24 into the cavity 8, which prevents the problem described above.

Third Exemplary Embodiment

Figure 12:
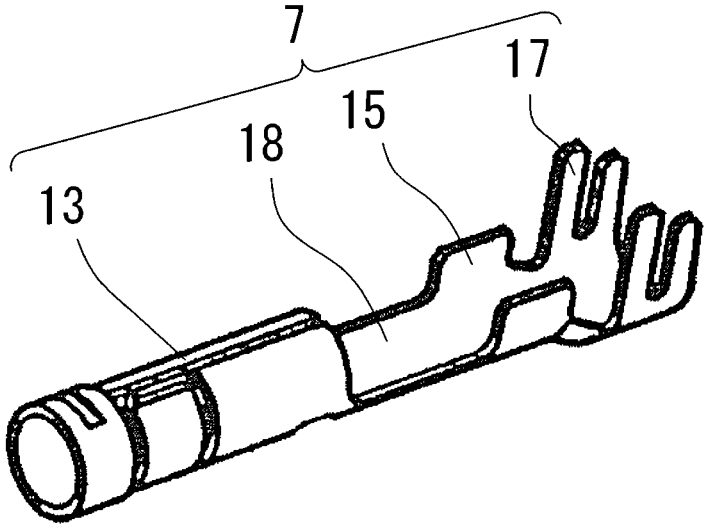
FIG. 12 is a perspective view of a contact according to a third exemplary embodiment.
Figure 13:
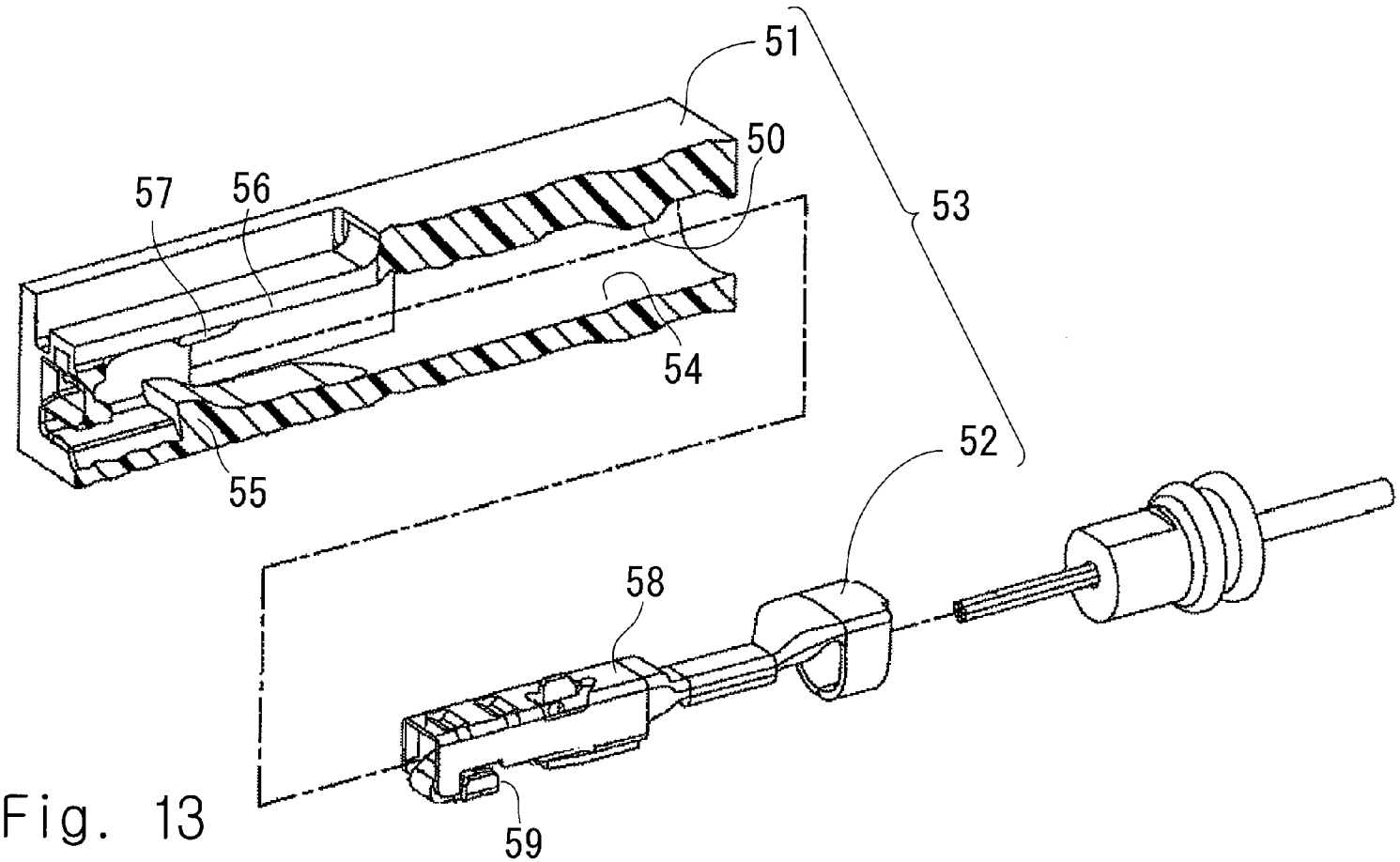
Fig. 13 PRIOR ART
FIG. 13 corresponds to FIG. 1 disclosed in Japanese Unexamined Patent Application Publication No. 2007-5310.

A third exemplary embodiment of the present invention will be described with reference to FIG. 12. In the third exemplary embodiment, the difference from the first exemplary embodiment and the second exemplary embodiment is mainly described and overlapping description is omitted as appropriate. Reference symbols that are identical to those in the first exemplary embodiment denote identical or similar components.

In the first and the second exemplary embodiments, the contact 7 includes the contact body 13 having a substantially prismatic cross section, as shown in FIG. 3A. In the third exemplary embodiment, however, the contact body 13 of the contact 7 may have a substantially cylindrical cross section, as shown in FIG. 12.

The connector 1 may be used as the waterproof connector as shown in FIG. 1, or may be used as a connector for applications other than waterproofing. Further, the contact 7 may be either a female contact or a male contact.

From the invention thus described, it will be obvious that the exemplary embodiments of the invention may be varied in many ways. Such variations are not to be regarded as a departure from the spirit and scope of the invention, and all such modifications as would be obvious to one skilled in the art are intended for inclusion within the scope of the following claims.

DESCRIPTION OF REFERENCE NUMERALS

| | |
|---|---|
| 1 | connector (waterproof connector) |
| 2 | front retainer |
| 3 | sealing |
| 4 | housing |
| 7 | contact |
| 8 | cavity |
| 9 | contact holding part |
| 9a | inner wall surface |

-continued

| | |
|---|---|
| 13 | contact body |
| 21 | pressing piece |
| 21c | sloped surface |
| 22 | locking member |
| 23 | abut part |
| 24 | retainer piece (supporting piece) |
| 28 | tapered part (pressing piece state sensing part) |
| 31 | tapered part |
| 32 | supporting side wall parts |
| 32a | first supporting side wall part (first supporting part) |
| 33 | extruding part (second supporting part, fitting state sensing part) |
| 33a | sloped surface |
| 34 | pressing piece contain space |
| e | moving direction |
| f | insertion direction (contact insertion direction) |
| g | pressing piece gap |
| h | gap |
| h1 | back-side gap (gap, first gap) |
| h2 | front-side gap (second gap) |

What is claimed is:

1. A connector comprising:

a contact;

a housing having a cavity into which the contact may be inserted formed therein, the housing retaining the contact inserted into the cavity; and a supporting piece that may be inserted into the cavity in the direction opposite to a direction in which the contact is inserted, wherein the housing comprises:

a pressing piece that moves the contact inserted into the cavity in a direction substantially perpendicular to the direction in which the contact is inserted;

an abut part that the contact abuts due to the movement by the pressing piece; and a locking member that locks the contact abutted to the abut part, the supporting piece is inserted into a gap formed between the contact and an inner wall surface of the housing due to the movement by the pressing piece, the supporting piece comprises:

a prismatic part that is formed to extend in a direction opposite to the contact insertion direction and is inserted into the gap to cause the gap to substantially disappear, so that the contact is sandwiched between the prismatic part and the abut part in a direction substantially perpendicular to the contact insertion direction and looseness of the contact in the cavity is suppressed; and a pressing piece state sensing part that is formed to extend in a direction opposite to the contact insertion direction from a distal end part of the prismatic part, abuts the pressing piece which is in a first state before the movement of the contact, and is contained in a gap formed between the pressing piece which is in a second state after the movement of the contact and the inner wall surface of the housing, the supporting piece comprises a pair of reinforced wall parts that sandwich the pressing piece state sensing part, a groove is formed by the pressing piece state sensing part and the pair of reinforced wall parts, the prismatic part comprises a first supporting surface;

each of the reinforced wall parts comprises a second supporting surface which is formed on the same plane as the first supporting surface; and the contact is supported by the first supporting surface of the prismatic part and the second supporting surfaces of the pair of reinforced wall parts.

2. A waterproof connector comprising:

the connector according to claim 1; and a sealing that prevents intrusion of moisture into the housing.

* * * * *